United States Patent [19]

Loutfy et al.

[11] 4,107,025

[45] Aug. 15, 1978

[54] STABLE ELECTRODE FOR ELECTROCHEMICAL APPLICATIONS

[75] Inventors: Raouf O. Loutfy, Pierrefonds; Paul P. K. Ho, Ile Bizard, both of Canada

[73] Assignee: Noranda Mines Limited, Toronto, Canada

[21] Appl. No.: 850,043

[22] Filed: Nov. 9, 1977

[51] Int. Cl.[2] ..... C25B 11/08

[52] U.S. Cl. ..... 204/290 F

[58] Field of Search ..... 204/290 R, 290 F

[56] References Cited

U.S. PATENT DOCUMENTS

| | | | |
|---|---|---|---|
| 3,502,506 | 3/1970 | Broyde | 429/40 |
| 3,804,740 | 4/1974 | Welch | 204/290 R |
| 3,839,181 | 10/1974 | Degueldre et al. | 204/290 F |
| 3,878,083 | 4/1975 | DeNora et al. | 204/290 F |
| 3,926,751 | 12/1975 | DeNora et al. | 204/105 R |
| 4,032,417 | 6/1977 | Peterson | 204/98 |

FOREIGN PATENT DOCUMENTS

| | | | |
|---|---|---|---|
| 1,164,477 | 9/1969 | United Kingdom | 204/290 F |

*Primary Examiner*—F.C. Edmundson
*Attorney, Agent, or Firm*—Fleit & Jacobson

[57] ABSTRACT

An electrode having good conductivity, low oxygen and chlorine overvoltage and a low corrosion rate under electrolysis conditions is disclosed. The electrode comprises an electrically conductive substrate made of a material resistant to the electrolyte and the electrolytic products, coated on at least a portion of the surface thereof with a basic coating of a material containing 30–70% by weight of an acid insoluble metal tungstate, 15–60% by weight tantalum pentoxide and 5–15% by weight of a noble metal oxide.

9 Claims, 2 Drawing Figures

STABLE ELECTRODE FOR ELECTROCHEMICAL APPLICATIONS

Figure 1:
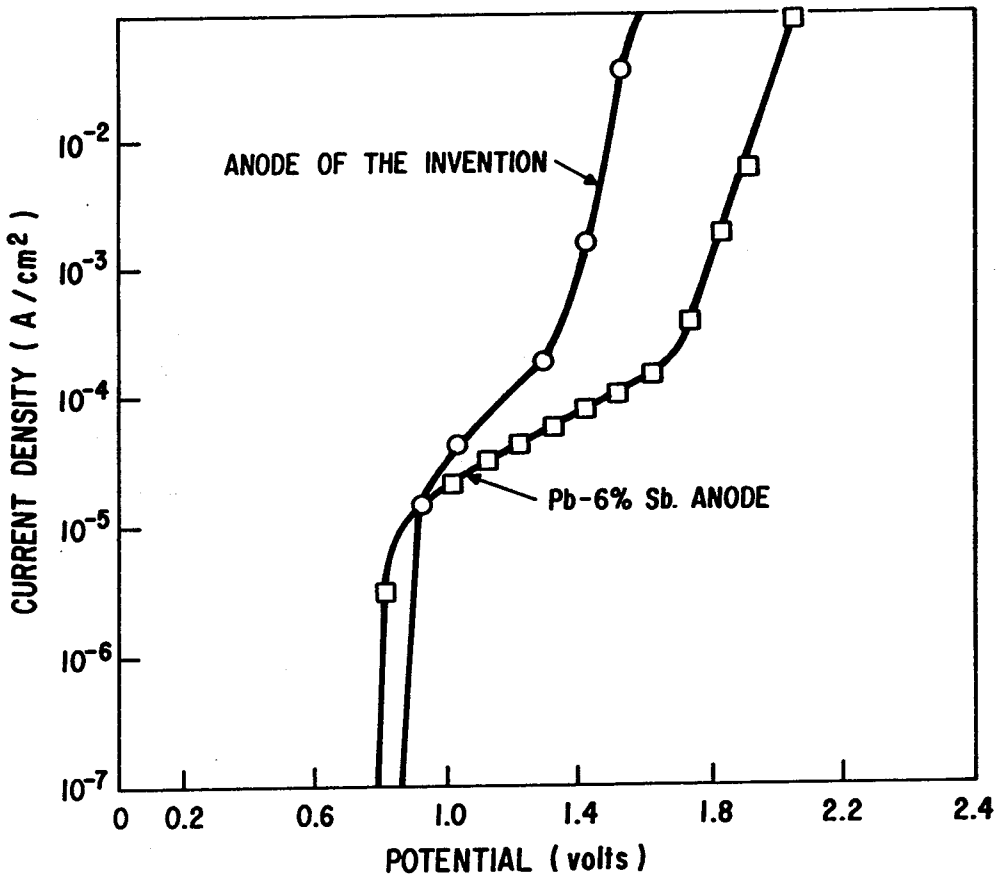

This invention relates to an electrode for use in electrochemical processes, more particularly as a dimensionally stable anode having good conductivity, low oxygen and chlorine overvoltage, and a low corrosion rate under acid electrolysis conditions.

An anode material suitable for use under electrolysis conditions must have the following properties:

(a) it must be a good conductor and must have the capacity to continue to conduct current to the electrolyte over long periods of time without becoming passivated;

(b) it must be an efficient electrocatalyst for the oxygen and chlorine evolution reaction, i.e. it must have a low oxygen and chlorine overvoltage; and (c) it must be corrosion resistant to severe electrolysis environment and the catalytic material must adhere firmly to the metal substrate to withstand mechanical degradation.

In practice, very few materials can satisfy the last of these requirements. The most common anode material in industrial use is lead dioxide which forms on lead and alloys of lead. When used in sulphate electrowinning, lead dioxide is electrochemically very stable when anodically polarized, but it reacts to form an insoluble lead sulphate coating when the anodic potential is reduced or interrupted. On subsequent application of current, this lead sulphate coating tends to be removed by exfoliation, and this can cause considerable contamination of the electrowon metal. This problem is particularly severe in the electrowinning of copper, where only little lead contamination can be tolerated. Thus alternate anode materials are being vigorously sought for this application, although none as yet has found extensive industrial use.

Various electrodes based on the use of valve metal substrates, such as titanium, tantalum, tungsten, zirconium, or alloys thereof, have been proposed. Of these, titanium is particularly suitable because of its relatively low cost compared to other valve metals.

On anodic polarization in acid sulphate or chloride solution, titanium is passivated by formation of a thin layer of rutile titanium dioxide, thus preventing the use of uncoated titanium as an anode material. However, several manufacturers have produced electrodes based on titanium substrates coated with thin layers of platinum, platinum iridium alloys, or other noble metals. These electrodes have the mechanical strength and non-reactivity in solution of the noble metal coating, and additionally have the advantage of low cost of the substrate material. Furthermore, if the substrate is exposed due to mechanical damage or chemical wear of the noble metal coating, passivation occurs, preventing serious degradation.

The noble metal coated titanium anodes represented a significant advance in the state of the art, but numerous experiments have demonstrated that in sulphuric acid electrolyte at elevated temperatures, the wear rate of these noble metal coatings, is too great for this electrode type to be considered as an economical possibility for electrowinning use.

An alternative and more economical type of inert electrode material has come into wide-spread use in recent years with the development of the mixed oxide, or solid solution, type of electrode coating such as disclosed in Canadian Pat. No. 932,700 issued to Henri B. Beer on Aug. 28, 1973. Electrodes based on this development comprise a valve metal base, generally titanium, with a coating consisting of a solid solution of a valve metal oxide and a noble metal oxide, typically titanium dioxide and ruthenium dioxide. The resulting electrodes show very good conductivity, and have low oxygen and chlorine overvoltages due to the electrocatalytic properties of ruthenium dioxide. Such electrodes are now becoming widely used in the chloro-alkali industry as anodes in the production of chlorine.

However, $RuO_2/TiO_2$ electrodes are not well suited to acid electrowinning use as they exhibit relatively high corrosion rates and passivation takes place after 200 to 1000 hours of operation. The use of a $RuO_2/Ta_2O_5$ mixed oxide coating improves the life of the anode somewhat but not enough for commercial use. $IrO_2TiO_2$ coatings or $IrO_2/Ta_2O_5$ coatings, such as proposed in Canadian Pat. No. 989,773 issued May 25, 1976, have substantially lower electrocatalytic activities except for coatings with high ratios of iridium to tantalum. However, the cost of the noble metal oxide $IrO_2$ is considerably higher than $RuO_2$ and the high concentration of the noble metal oxide required, which is used typically in the range of 20 to 40%, results in a high overall cost for these electrodes.

Applicant has now developed an electrode having a coating composition which allows a considerably lower concentration of noble metal oxide, i.e. $RuO_2$ or $IrO_2$, without hindering the catalytic performance of the coating and without causing premature passivation of the electrode under conditions of both oxygen and chlorine evolution. The proposed coating formulation also exhibits low corrosion rate in the electrode as compared to existing electrodes.

The electrode, in accordance with the invention, comprises an electrically conductive substrate made of a material resistant to the electrolyte and the electrolytic products thereof, coated on at least a portion of the surface thereof with a basic coating material containing 30–70% by weight of an acid insoluble metal tungstate, 15–60% by weight tantalum pentoxide and 5–15% by weight of a noble metal oxide.

The metal tungstate is preferably $MnWO_4$, $CoWO_4$, or $ZrWO_4$ as these metal tungstate have been found to be highly acid resistant compounds. The noble metal oxide is also preferably ruthenium or iridium.

The substrate is preferably made of a valve metal selected from the group consisting of titanium, tantalum, tungsten, zirconium, niobium or alloys thereof. However, other conductive metals which are not affected by the electrolyte and the products formed during electrolysis may be used such as metal electrodes cladded with the above mentioned valve metals.

After having been subjected to the conventional degreasing and cleaning treatments, the substrates are preferably coated with an undercoat layer rich in noble metal oxide, preferably a mixed-crystal layer of $Ta_2O_5$ and $RuO_2$ having the composition range of 0–80% and 100–20% by weight respectively. The purpose of this undercoat layer is to overcome the possible passivation of the electrode due to oxidation of the substrate underneath the coating material, causing the passage of current to be interrupted by the growing oxide insulating flim. This behaviour has been overcome by redistribution of the concentration of the noble metal oxide in the electrode coating by applying an undercoat layer rich in noble metal oxide before application of a top coating.

The preferred undercoating layer contains about 50% $Ta_2O_5$ and 50% noble metal oxide.

The undercoat layer is preferably applied by the known mixed-crystal technique. This technique involves co-precipitation of all the materials of the coating layers so that the molecular lattices of one material forming the coating composition is interwined with the molecular lattices of the other materials constituting the coating. There are various methods of achieving this result. One method which has been used by the applicant consists in preparing a solution containing the materials to be co-precipitated and a suitable solvent. The solution is then applied to the substrate by painting the solution on the substrate or dipping the substrate into it. The solvent is thereafter evaporated followed by heating in air of the residue remaining on the substrate after evaporation to produce the coating of mixed-crystals.

The top coating is also applied by the same co-precipitation technique but only $Ta_2O_5$ and the noble metal oxide are precipitated as mixed oxides. The metal tungstate precipitates as a physical mixture with the mixed-crystal structure of $Ta_2O_5$ and the noble metal oxide.

Figure 2:
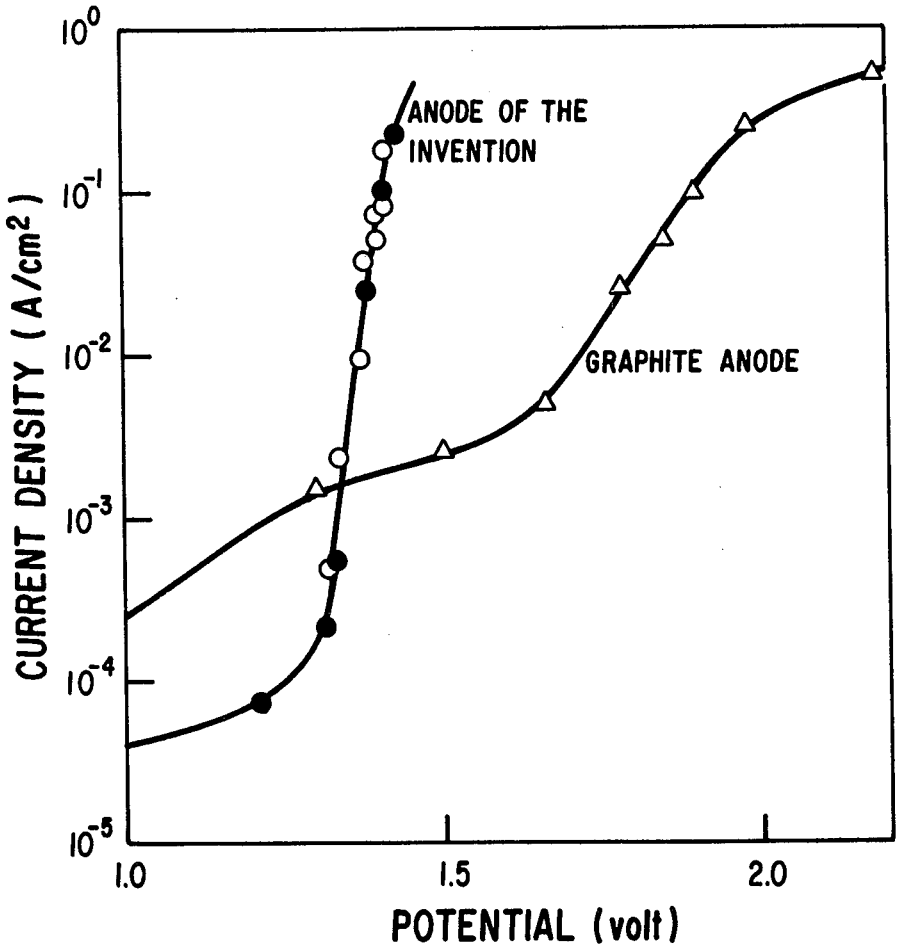

The invention will now be disclosed, by way of example, with reference to the accompanying drawings in which:

FIG. 1 illustrates the polarization curve of the present electrode in comparison with a lead dioxide electrode for oxygen evolution; and FIG. 2 illustrates the polarization curve of the present electrode in comparison with a carbon electrode for chlorine evolution.

Fine sandblasted titanium substrates of size 50 mm × 80 mm, as the electroconductive base of the electrode, were etched in 10% oxalic acid at 90° C for 4 hours. After etching of the titanium substrates and thorough rinsing with acetone and distilled water, the substrates were painted with various undercoating solutions of a thermally decomposable compound of tantalum and a thermally decomposable compound of a noble metal oxide such as ruthenium or iridium to produce undercoats having the composition range of 0–80% and 100–20% by weight respectively, of $Ta_2O_5$ and noble metal oxide, preferably about 50% $Ta_2O_5$ and 50% noble metal oxide after evaporation of the solvent and heating of the dried electrode base in the presence of oxygen containing gas.

The heating step was effected at 400°–550° C, preferably 500° C, for 5–10 minutes in a muffle furnace. This procedure was repeated several times to build up the coating weight to a level of 0.5–2 mg/cm$^2$.

After the preliminary undercoat was applied, the electrodes were painted with a top coating solution of an acid insoluble metal tungstate and a thermally decomposable compound of tantalum and a thermally decomposable compound of a noble metal oxide such as ruthenium or iridium to produce electrodes with an overall composition of 30–70% metal tungstate, 5–15% noble metal oxide, and 15–60% $Ta_2O_5$, preferably 40-60% metal tungstate, 5–15% noble metal oxide, and 35–55% $Ta_2O_5$, after evaporation of the solvent and heating of the dried electrode in the presence of oxygen containing gas. In order to have the above overall composition, the top coating had a composition of 30-90% metal tungstate, 0–15% noble metal oxide and 5–65% $Ta_2O_5$.

The heating step was also effected at a temperature of 400°–550° C, preferably 500° C, for 5–10 minutes in a muffle furnace. The painting procedure was repeated several times to obtain the desired final composition of the electrode coating formulation. For example, if the composition of the undercoat was 50% $RuO_2$ with a coating weight of 1 mg/cm$^2$, the composition of the top coating 5% $RuO_2$, and the desired composition of the overall coating 10% $RuO_2$, then by solving the equation $$50 \times 1 + 5 \times \chi = 10\,(1 + \chi)$$

the coating weight $\chi$ of the top coating needed be 8 mg/cm$^2$.

The above procedure of electrode preparation ensures the presence of an undercoating layer rich in noble metal oxide before the application of the basic coating. This undercoat prevents the passivation of the electrode by preventing the oxidation of the titanium substrate underneath the coating material. As a result of this redistribution of the noble metal oxide concentration in two coats, a low corrosion rate of the electrodes is also achieved. This is due to the low concentration level of the noble metal oxide in the top coat.

A potentiostatic characterization of the electrodes prepared according to the above was carried out in 200 gpl sulphuric acid at temperatures of 60°–65° C and in brine solution having a concentration of 28% and a temperature of 80° C. The electrodes were also tested by continuous electrolysis in 200 gpl sulphuric acid (18%) at a current density of 20 mA/cm$^2$ at 60°–65° C and by determining the anode potential for each anode as a function of electrolysis duration. The electrodes were also tested by continuous electrolysis in 28% sodium chloride solution at a current density of 200 mA/cm$^2$ at 80° C and the anode potential was measured as a function of electrolysis duration. The following are several examples of these electrodes:

EXAMPLE I

Titanium plates 50 mm by 80 mm were fine sandblasted and etched in 10% oxalic and at 90° C for 4 hours, and were then thoroughly washed with acetone and water. The plates were then coated by brushing a solution typically containing the following composition:

$TaCl_5$: 0.2027 gm
$RuCl_3$ — $3H_2O$: 0.2700 gm
n — butyl alcohol: 3 – 15 ml
HCl (36%): 0.3 – 1.5 ml After the application of each coat, the plates were dried and then heated for 5 minutes at 500° C in a muffle furnace. The resulting undercoat had a coating composition of about 50% $Ta_2O_5$ and 50% $RuO_2$. This coat was typically 1–2 mg/cm$^2$. After the preliminary undercoat was applied the plates were painted with a solution typically containing the following:

$MnWO_4$: 0.445 gm
$TaCl_5$: 0.8836 gm
$RuCl_3$ $3H_2O$: 0.0216 gm
n — butyl alcohol: 5 – 15 ml
HCl (36%): 0.5 – 15 ml After the application of each coat, the plates were dried and then heated for 5 minutes at 500° C in a muffle furnace. The resulting top coat had a coating composition of 1 - 5% $RuO_2$, 40-60% $Ta_2O_5$ and 40-60% $MnWO_4$. This top coat was typically 7 - 9 mg/cm$^2$.

For example, to produce an electrode having an overall coating composition of 12% $RuO_2$, 43% $Ta_2O_5$ and 45% $MnWO_4$, the composition of the undercoating was 50% $RuO_2$ and 50% $Ta_2O_5$ with a coating weight of 2 mg/cm$^2$, and the composition of the top coating was 3.6% $RuO_2$, 41.4% $Ta_2O_5$ and 55% $MnWO_4$ with a coating weight of 9 mg/cm$^2$. The overall coating weight was 11 mg/cm$^2$.

The value of the initial anode potential, the average anode potential after electrolysis, and duration of electrolysis for various manganese tungstate anodes, in sulfuric acid solution, are summarized in Table I, together with anodes prepared in a similar fashion, but without the presence of $MnWO_4$.

TABLE I

| Anode | Overall Coating Compositions % | | Anode Potential, V (NHE) at 20 mA/cm$^2$ Initial Value | After Electrolysis | Electrolysis Duration (hours) |
|---|---|---|---|---|---|
| 1 | $RuO_2$ | 100% | 1.55 | 1.55->10 | Passivated in 216 hrs |
| 2 | $RuO_2$ | 50% | 1.55 | 1.55->10 | Passivated in 312 hrs |
| | $Ta_2O_5$ | 50% | | | |
| 3 | $RuO_2$ | 10% | | | |
| | $Ta_2O_5$ | 90% | 1.55 | 1.55->10 | Passivated in 48 hrs |
| 4 | $MnWO_4$ | 45% | | | |
| | $RuO_2$ | 12% | | | |
| | $Ta_2O_5$ | 43% | 1.55 | 1.51 | >7000 |
| 5 | $MnWO_4$ | 40% | | | |
| | $RuO_2$ | 6% | | | |
| | $Ta_2O_5$ | 54% | 1.56 | 1.51 | >7000 |

The results of Table I show that the electrodes of this invention have high electrocatalytic activity even though the concentration of the noble metal oxide is relatively very low compared to that reported in Canadian Pat. No. 989,773 in which the ratio of noble metal oxide to other components is in the order of 0.50 to 1.0 or 1.5 to 1.0 and consisting of a noble metal oxide in a percentage of 30-60% of the coating formulation.

It could also be seen from the results of Table I that in absence of $MnWO_4$ in the coating formulation, electrodes with low concentration of $RuO_2$ (10%) became passivated after only a short period of electrolysis. Even those electrodes with high concentration of $RuO_2$, but without the incorporation of $MnWO_4$ exhibit rapid passivation upon electrolysis.

A typical potentiostatic characterization of these manganese tungstate electrodes as an oxygen electrode is presented in FIG. 1. The polarization for lead electrodes (Pb-6% 5b), preconditioned according to standard electrowinning plant practice, is also shown in FIG. 1. Electrodes prepared according to this invention show a very low oxygen overvoltage up to a current density of 100 mA/cm$^2$. A 450 to 500 mV decrease in oxygen overvoltage could be obtained using these electrodes as compared to using lead anodes for metal electrowinning at the conventional current density of about 20 mA/cm$^2$.

EXAMPLE 2

Titanium plates 50 mm by 80 mm were fine sandblasted and etched in 10% oxalic acid at 90° C for 4 hours and were thoroughly washed with acetone and water. The plates were then coated with a preliminary undercoat by brushing an aqueous solution containing iridium chloride and tantalum pentachloride in a ratio to produce a coating composition of about 50% $IrO_2$ and 50% $Ta_2O_5$ after solvent evaporation and thermal decomposition of the metal chlorides. The compositions were applied in 2 to 5 coats with intermediate heating at 500° C for 5 minutes in a muffle furnace. A top coat was then applied on the plates by brushing a sloution containing manganese tungstate, iridium chloride and tantalum pentachloride in a ratio to produce the final composition given in Table II, after solvent evaporation and thermal decomposition of the metal chlorides. The compositions were applied in 5 to 10 coats with intermediate heating at 500° C for 5 minutes. The anode potentials were determined as in Example I and the results are reported in Table II, together with results obtained for electrodes prepared without manganese tungstate.

TABLE II

| Anode | Overall Coating Compositions % | | Anode Potential, V (NHE) at 20 mA/cm$^2$ Initial Value | Electrolysis | Electrolysis Duration (hours) |
|---|---|---|---|---|---|
| 6 | $IrO_2$ | 25% | 1.62 | 1.67->10 | Passivated in 120 hrs |
| | $Ta_2O_5$ | 75% | | | |
| 7 | $MnWO_4$ | 43% | 1.59 | 1.60 | >2000 |
| | $IrO_2$ | 11% | | | |
| | $Ta_2O_5$ | 46% | | | |

The results in Table II show that the electrodes of this invention have high electrocatalytic activity even though the concentration of the iridium oxide is relatively low. It could also be seen that in the absence of $MnWO_4$ in the coating formulation, electrodes with even high $IrO_2$ concentration (25%) became passivated after only a short period of electrolysis.

EXAMPLE 3

Titanium plates were treated and coated as in Example 1 except manganese tungstate was replaced by cobalt tungstate in the top coat. The overall electrode composition and anode potentials are reported in Table III, together with the results of corresponding electrodes prepared without $CoWO_4$.

TABLE III

| Anode | Overall Coating Compositions % | | Anode Potential, V (NHE) at 20 mA/cm² Initial Value | After Electrolysis | Electrolysis Duration (hours) |
|---|---|---|---|---|---|
| 8 | $RuO_2$ | 12% | 1.55 | 1.55 - >10 | 52 |
| | $Ta_2O_5$ | 88% | | | |
| 9 | $CoWO_4$ | 42.5% | 1.56 | 1.52 | >2500 |
| | $RuO_2$ | 12.0% | | | |
| | $Ta_2O_5$ | 45.5% | | | |

The results of Table III show that the presence of $CoWO_4$ in the electrode formulation prevents the pasivation of the anode.

EXAMPLE 4

Titanium plates were treated and coated as in example 1 with an overall coating composition of 53% $MnWO_4$ — 7% $RuO_2$ — 40% $Ta_2O_5$. The electrodes were tested by continuous electrolysis in brine solution having a concentration of 28% sodium chloride and electrolyte temperature of 80° C. A typical potentiostatic characterization of these manganese tungstate electrodes as a chlorine electrode is presented in FIG. 2. The polarization for the conventionally used graphite anode for chlorine evolution is also presented in FIG. 2. Electrodes prepared according to the above composition show a very low chlorine overvoltage even though the concentration of the noble metal oxide is relatively very low compared to the type of electrodes disclosed in Canadian Pat. No. 932,700 issued to Henri B. Beer on Aug. 28, 1973. A 500–600 mV decrease in chlorine overvoltage could be obtained using these electrodes as compared to using graphite anodes for chlorine evolution at conventional current density of 100 to 250 $mA/cm^2$.

X-ray diffraction analysis of all electrodes identified the presence of metal tungstate, as one entity, tantalum pentoxide and the noble metal dioxide on the electrode surface.

Other metal tungstates such as $CdWO_4$, $CaWO_4$ and $Al_2(WO_4)_3$ were also tested but it was found that such metal tungstates were not acid resistant enough to be used in electrowinning solutions.

The embodiments of the invention in which an exclusive property or privilege is claimed are defined as follows:

1. An electrode for use in an electrolytic process comprising an electrically conductive substrate made of a material resistant to the electrolyte and the electrolytic products thereof, coated on at least a portion of its surface with a basic coating of a material containing 30–70% by weight of an acid insoluble metal tungstate, 15–60% by weight $Ta_2O_5$ and 5–15% by weight of a noble metal oxide.

2. An electrode as defined in claim 1, wherein the metal tungstate is selected from the group consisting of $MnWO_4$, $ZrWO_4$ and $CoWO_4$.

3. An electrode as defined in claim 1, wherein the noble metal oxide is ruthenium or iridium.

4. An electrode as defined in claim 1, wherein said substrate is made of a valve metal selected from the group consisting of titanium, tantalum, tungsten, zirconium, niobium or alloys thereof.

5. An electrode as defined in claim 1, wherein said substrate is made of metal cladded with a valve metal selected from the group consisting of titanium, tantalum, tungsten, zirconium, niobium or alloys thereof.

6. An electrode as defined in claim 1, wherein said substrate is coated with an undercoat layer rich in noble metal oxide covered with a top coating so as to form said basic coating.

7. An electrode as defined in claim 6, wherein said undercoat layer is made of a mixed-crystal material containing $Ta_2O_5$ and $RuO_2$ having a composition range of 0–80% and 100–20% by weight respectively.

8. An electrode as defined in claim 7, wherein said undercoat layer contains about 50% $Ta_2O_5$ and 50% $RuO_2$, and said top coat contains 30–90% $MnWO_4$, 0–15% $RuO_2$ and 5–65% $Ta_2O_5$.

9. An electrode as defined in claim 8, wherein said basic coating contains 40–60% $MnWO_4$, 5–15% $RuO_2$ and 33–55% $Ta_2O_5$.

* * * * *